United States Patent [19]

Bratland

[11] Patent Number: 4,800,922

[45] Date of Patent: Jan. 31, 1989

[54] HYDRAULICALLY CONTROLLED MANEUVERING DEVICE

[76] Inventor: Ove Bratland, Romolslia 48, N-7000 Trondheim, Norway

[21] Appl. No.: 910,229

[22] PCT Filed: Jan. 6, 1986

[86] PCT No.: PCT/NO86/00001

§ 371 Date: Sep. 29, 1986

§ 102(e) Date: Sep. 29, 1986

[87] PCT Pub. No.: WO86/04120

PCT Pub. Date: Jul. 17, 1986

[30] Foreign Application Priority Data

Jan. 4, 1985 [NO] Norway ..... 850033

[51] Int. Cl.[4] ..... F15B 21/12

[52] U.S. Cl. ..... 137/624.14; 137/624.13

[58] Field of Search ..... 137/624.14, 624.13

[56] References Cited

U.S. PATENT DOCUMENTS 2,945,478 7/1960 Hanna .

4,308,884 1/1982 Hoerger et al. ..... 137/624.11 X 4,687,014 8/1987 Godal ..... 137/624.14 X

*Primary Examiner*—Gerald A. Michalsky

*Attorney, Agent, or Firm*—Barnes & Thornburg

[57] ABSTRACT

Hydraulically controlled value with a movable body (10) that is kept in neutral position under tension by two spring units (21, 22) between two pressure chambers (8, 9). The pressure chambers are connected by a common controlling conduit (25) for the signal medium. A hydraulic accumulator (30) is connected to one of the pressure chambers (9). It is possible to determine the natural frequency of the accumulator and its connector tube. By varying the pressure on the signal medium with a frequency which corresponds with the natural frequency of the accumulator (30), the body is set in motion between open and closed position, with a corresponding frequency. The body (10) is preferably formed as a valve slide for direct control of a valve. Alternatively, the body can mechanically actuate a valve etc. by means of, for example, an actuator or an electric sensor.

17 Claims, 4 Drawing Sheets

HYDRAULICALLY CONTROLLED MANEUVERING DEVICE

The invention concerns a hydraulically controlled valve of the type including a moveable valve body situated within a housing biased to a neutral position between two hydraulic pressure chambers.

In various systems it is desirable to remotely control an apparatus without the use of electrical signal wires. Such is the case with underwater valves for oil production and also in environments where there is a risk of explosion.

Cost and safety are two important factors in connection with oil activity at sea. This is especially true for underwater production systems. For small wells, remote-controlled valve trees mounted directly on the seabed have often proved to be expedient. These can be controlled from the surface, e.g. from a platform by hydraulic lines, and, perhaps by electric cables.

In earlier known control systems that consist of only hydraulic components, in other words where the control is hydraulic, long reaction time is a problem even when the distance of transmission is moderate. The main cause of this is that in existing hydraulic systems each valve activation requires a change in the pressure level in a signal wire. Change of pressure in a long narrow hose or even a long narrow pipe generally takes a lot of time because of compressible and viscous effects.

In order to reduce reaction time, the attempt has been made to use various forms of hydraulic control apparatuses. The control signal is, then, electrical, while the work operation is hydraulic. Such systems are practicable for large distances and when many valves are to be controlled.

However, such systems are comparatively complicated and costly. Another negative aspect is that the electrical lines must be connected under water. This can reduce reliability and increase cost.

The main purpose of the invention is, therefore, to create a hydraulically controlled valve that is especially suited for controlling other valves in underwater production systems, and that can be operated hydraulically in a more satisfactory manner than is the case with presently known devices. Primarily, it must be possible for the device to run with a shorter reaction time. In addition, it must be simple and reliable as all interuptions caused by failure will have major economic consequences, both directly an indirectly.

According to the invention this can be achieved by constructing the valve to include a moveable valve body situated within a housing and biased to a neutral position between hydraulic pressure chambers. A common conduit connects both pressure chambers to a source of a signal medium. A hydraulic accumulator means having a preselected natural frequency is connected one of the pressure chambers. A modulated signal is provided of a frequency related to the preselected natural frequency of the accumulator means so as to be reenforced thereby causing displacement of the valve body within the housing away from the neutral biased position.

Such a valve can be activated by sinus-formed pressure pulses with a specified frequency or specified frequency range. In addition to solving the control problem for a single valve, in an advantageously manner, the valve according to the invention makes it possible to create control systems with a plurality of units that are controlled through a single control line. The valves are constructed in a manner such as they give response to pressure pulses of different frequencies or within different frequency ranges. In other words, each valve in such a system is made sensitive to a pre-determined frequency interval. An operator on a platform, for example, can select which valve is to be operated by selecting and releasing pressure pulses with the signal frequency that the unit will respond to.

The mean pressure level in the signal wire can thus be kept constant, as only small, relatively rapid variations around the mean value are introduced. According to the invention, it is possible to construct the valve so that it is relatively sensitive allowing the size of these variations to be minimal.

The valve, according to the invention, is primarily suited for controlling valves at so-called satellite wells and on such valves as underwater emergency shut-off valves which, for safety reasons, are mounted on production pipes for oil and gas. Further, it can be used in systems where liquid guiding pipes or hosts are mounted, and where one wants to avoid mounting of additionally electric cables.

In water power stations it can, for example, be used for closing off the isolating valve by sending hydraulic signals through the pipe track. In waterworks it can be used to activate the shut-off valves. It can be used in environments where there is a danger of explosion, where electrical lines can increase the danger caused by sparks, for example on oil platforms, on tankers, and at oil refineries. It can be used to remotely control tools (the "pig") when cleaning or inspecting the production pipes.

The signals can be sent through the same pipes that the tools are working in, the principle can be utilized, for example, to determine the working position of the tool (e.g. the brushes' press force.)

Other features concerning the invention will become appararent to those of ordinary skill upon consideration of the following detailed description of preferred embodiments exemplifying the best mode of carrying out the invention as presently perceived.

In addition, the invention is described in more detail with reference to the figures where.

FIGS. 3 and 4 show sections of modifications of the embodiment in FIG. 2, while

Figure 1:
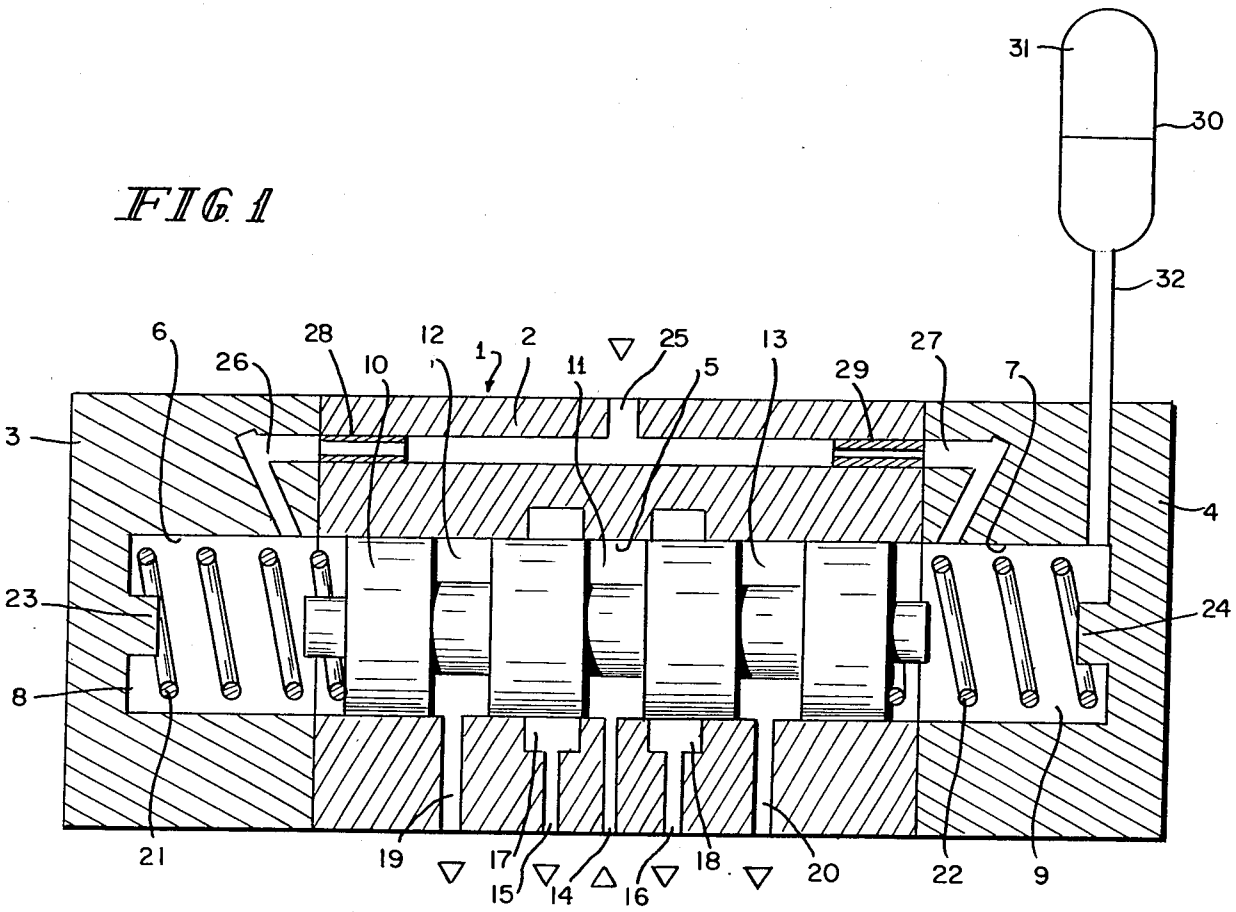
FIG. 1 shows an axial section through one embodiment of the invention.

The valve in the example in FIG. 1 includes a valve housing, 1, with a central main part, 2, and two end elements, 3 and 4 respectively.

The end elements, 3 and 4, are fastened to the main part, 2, with screw connections that are not shown.

The main part, 2, has an axial, through-going slide bore, 5 that extends into blind bores, 6 and 7, in the end elements 3 and 4 respectively. Each blind bore, 6 and 7, forms an end chamber which in the following text will be called left end chamber 8 and right end chamber 9.

In the slide bore, 5 between the end chambers 8 and 9, a movable slide, 10, is placed. The slide, 10, has in a known manner, a central ring groove, 11, and two ring grooves, one left, 12, and one right, 13 respectively, which are positioned symmetrically on either side. In addition, a centrally positioned radial inlet, 14, and two corresponding outlets, a left outlet, 15, and a right outlet, 16, that are intended for the passage of the medium which is to be controlled. Each of the outlets, 15 and 16, empties internally into its respective ring groove, 17 and 18, in the wall of the slide bore, 13.

In addition to the inlets and outlets mentioned above, there are two channels for carrying away leakage medium. These are the left leakage channel 19, and the right leakage channel 20. The slide 10 is kept fixed in its middle position by a coil spring at each end, a coil spring 21 in the left end chamber 8 and a coil spring 22 in the right end chamber 9, respectively.

The slide movement away from the middle position is limited by a stopper in each of the end chambers: a left stopper, 23 and a right stopper, 24, respectively.

To control slide, 10, there is a controlling chamber 25, that extends from the main part of the valve housing, 2, through two symmetrical branch channels, 26 and 27, in the left and right parts, respectively, of the valve housing, 1, and through to the corresponding end chambers, 8 and 9.

In each of the two branch channels, 26 and 27, a throttle bushing is set in at the end of the main part of the valve housing. The throttle bushing, 28, on the left side, is relatively open, while the throttle bushing, 29, on the right side, is more constricted.

When there is a constant medium pressure at the entrance of the controlling chamber, 25, the slide, 10, will be in the middle position with closed outlet grooves, 17 and 18. The springs, 21 and 22, will be equally rigid and the pressure in the end chambers, 8 and 9, will equal.

An accumulator, 30, with a gas pocket, 31, is connected to the right end chamber, 9, by a connecting tube, 32. The accumulator can have capacitance elements other than gas, for example, liquids, a mechanical spring with a piston, or a block of compressible material such as plastic or rubber.

The accumulator, 30, and the connecting tube, 32, will have a neutral frequency, determined by the volume of gas and the diameter of the opening, and the length of the connecting tube, 32. The tube, 32, can be interchanged and/or throttled, in order to regulate the natural frequency. The volume of gas is determined by regulating the pre-charge pressure in the accumulator, 30, before the system is put into operation. This natural frequency, which can be a few Hz, can be determined experimentally and can be adjusted by varying the parameters mentioned above. Maximum natural frequency can be approximately 250 Hz, but is usually not more than 50 Hz.

Varying the pressure on the signal entry, 25, periodically, disturbs the symmetry in the system. The throttle bushing, 29, will minimize the pressure variation in the right end chamber, 9. Further pressure equalization is provided by the accumulator, 30.

In the left end chamber, 8, meanwhile, the pulses are suppressed much less by the left throttle bushing, 28. Thereby a resultant force on the slide, 10, will be created that will force the slide out of equilibrium.

In the controlling channel, 25, there may be a base pressure of several hundred bars. Pressure variation may measure 1 bar. In most relevant situations, a variation of approximately 0.1 bar even down to 0.01 bar, is sufficient to control the valves if the springs, 21. and 22, are constructed with a low spring constant.

The oscillation of the slide, 10, between the end positions will give a pulsating medium current out of the outlets 15 and 16.

Figure 2:
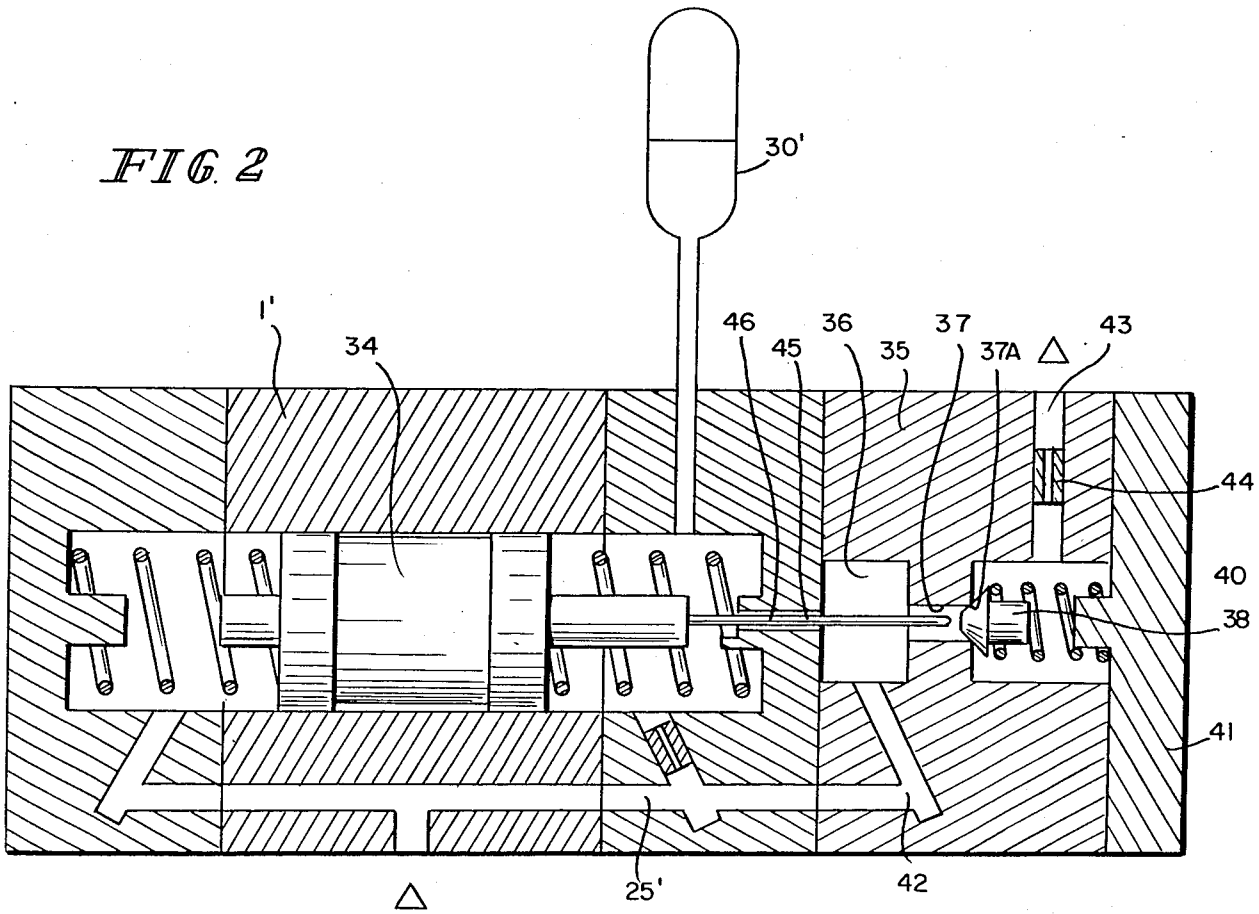
FIG. 2 shows an axial section of a second embodiment of the invention

In FIG. 2, an alternative embodiment is shown. Corresponding parts are indicated with corresponding numbers. The valve slide, 10, from the example in FIG. 1, is replaced with an oscillating body, 34. In an axial extension of the housing 1'', a valve housing, 35, with an axial bore, 36, is connected.

A constriction, 37, in the bore, 36, comprises the valve seat, 37A, for a conical valve body, 38, in an outer valve chamber, 39. The valve body, 38, is kept fixed against the closed position by a coil spring, 40, in the valve chamber, 38, which is closed by a cover 41.

The supply channel to the valve body, 38, is a bore, 42, through the valve housing, 35, in from the controlling channel 25. The discharge channel is a bore, 43, that runs sideways out from the valve chamber, 39. In this bore, 43, there is a throttle bushing 44. This is to prevent the pressure fall from becoming too great at the valve opening.

In order to control the valve body, 38, the oscillating body, 34, is provided with an actuator shaft, 45, which extends toward the valve body, 38, through a central bore, 46, in the end wall of the housing 1' toward the valve housing, 35.

Figure 3:
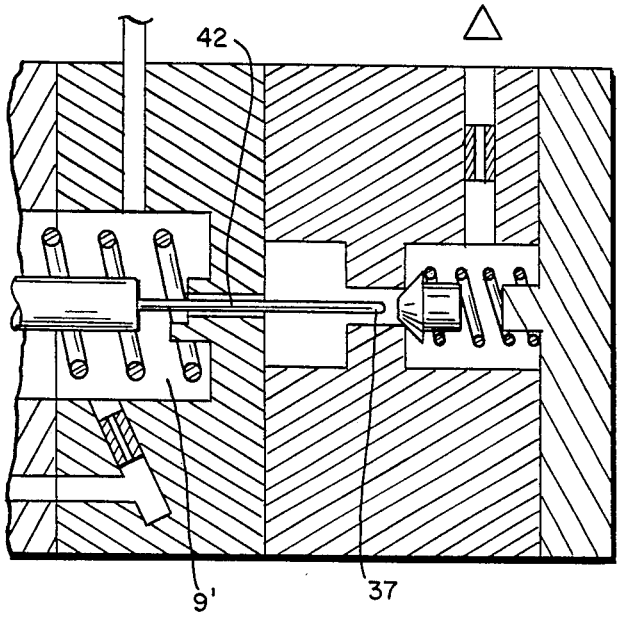

In FIG. 3 a section is shown of a modification of the embodiment in FIG. 2; the supply to the valve bore, 37', comes from the end chamber, 9', and through the bore, 42. When the valve body, 38, opens, the pressure falls in this part of the system and oscillating body, 34, will be pressed further toward the right in the figure. The valve body, 38, will remain in this position until the pressure falls under the threshold value in the signal wire, or until the consumer (not shown) stops receiving oil.

Figure 4:
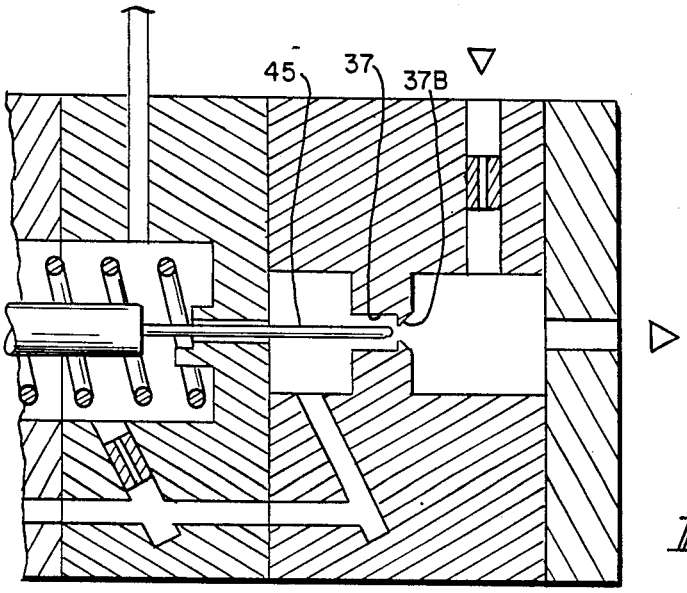

In FIG. 4, section is shown of yet another modified embodiment of the device in FIG. 2 where the valve body is omitted and the bore, 37, is shaped with a constriction or nozzle, 37B, the opening of which is controlled by the actuator shaft, 45.

Figure 5:
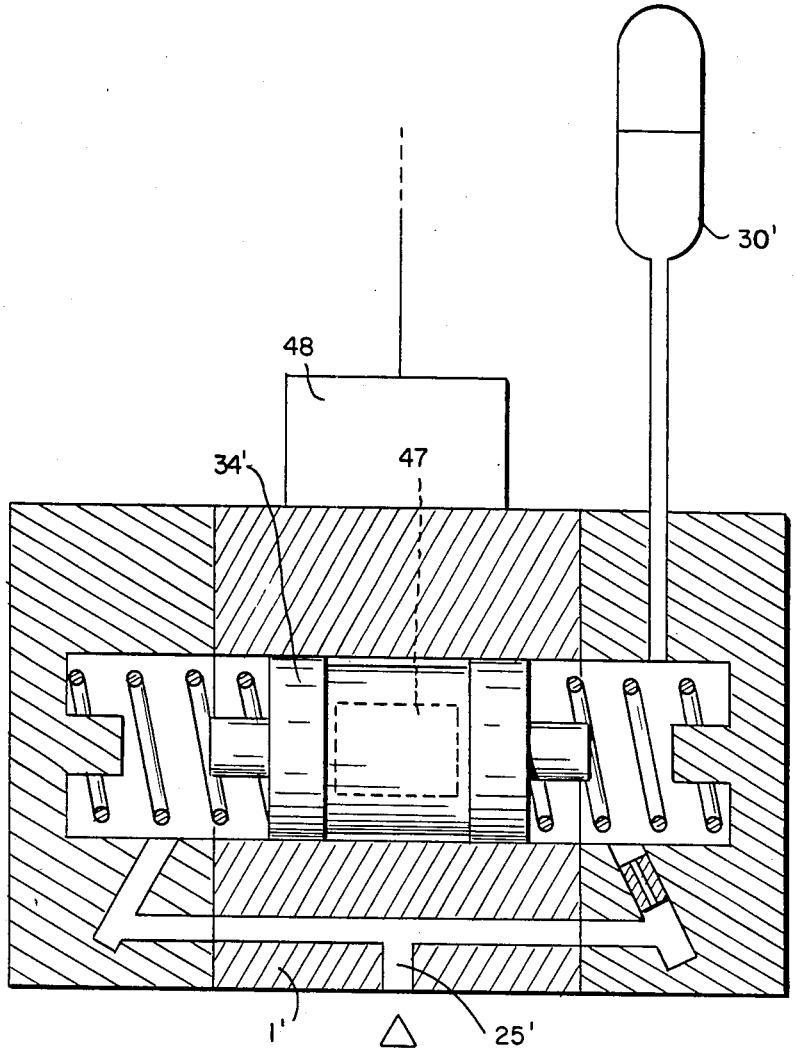
FIG. 5 shows a third embodiment.

FIG. 5 shows yet another embodiment of the invention. Here there is an oscillating body, 34', which corresponds to the oscillating body, 34, in FIG. 2, with the exception that there is no valve. A ferromagnetic element, 47, is provided for transferring the controlling impulse from the oscillating body, 34'. On the outside of the housing 1'' that consists of non-ferromagnetic material there is an inductive sensor, 48. This can be connected in a known manner so as to control a given apparatus such as a valve.

As an alternative, a suitably electrically based sensor (not shown) can be positioned in one of the end chambers.

I claim:

1. A hydraulically controlled valve where, between two chambers (8, 9) for hydraulic medium, a movable body (10) is placed which is held in middle position under tension from both sides by biasing means (21, 22), and the movable body can be displaced from middle position by supplying different medium pressures in the two chambers (8, 9) and where there are means for transferring the body's movement as a maneuvering impulse to a control system, characterized in that the two pressure chambers (8, 9) are connected by a common conduit (25) for the signal medium, and that a hydraulic accumulator (30) which together with its connector tube has a selectable natural frequency, is connected to one of the pressure chambers (9) while the pressure of the signal medium is devised for controlled variation with a frequency which corresponds to the natural frequency of the accumulator (30) to displace the movable body (10) away from its middle position.

2. Valve according to claim 1, characterized in that the one pressure chamber (9) is connected to an accumulator (30) that contains a compressible medium (31), and which is devised for regulation of the characteristic of the compressible medium (31).

3. Valve according to claim 1, characterized in that an inlet (27) of the common conduit (25) to the pressure chamber (9) that is connected to the accumulator (30), is equipped with a throttle device (27) which limits the flow differentially to the other pressure chamber (8).

4. A valve according to claim 1 characterized in that the movable body is composed of a valve slide (10) in a slide valve.

5. A valve according to claim 1 characterized in that the body (34) is connected with a controlling valve (38) by a mechanical actuator (45).

6. A valve according to claim 1, characterized in that the movable body (34) is coupled to sensor means (48).

7. A control valve comprising: a housing containing a bore, a movable body situated within the bore, biasing means for biasing the body to a central position in the bore so as to define a pressure chamber between each end of the bore and a confronting end of the movable body, a conduit coupling the pressure chamber to each other and for coupling to a source of a hydraulic signal, throttling means within the conduit for diminishing the hydraulic signal to one of the two pressure chambers, and a hydraulic accumulator having a natural resonant frequency connected to one of the pressure chambers.

8. A control valve according to claim 7 wherein the natural resonant frequency of the hydraulic accumulator is between about a few Hz. and 250 Hz.

9. A control valve according to claim 8 wherein the natural resonant frequency of the hydraulic accumulator is between about a few Hz. and 50 Hz.

10. A control valve according to claim 7 wherein the biasing means comprises springs situated at each end of the valve body.

11. A control valve according to claim 7 wherein the housing contains a first and second chamber at one end of the bore, a first opening connecting the first chamber to one of the pressure chambers, a second opening connecting the first chamber to the second chamber, and a rod fixed to the movable body protruding through the first opening and into the second opening.

12. A control valve according to claim 11 wherein said conduit is additionally coupled to the first chamber.

13. A control valve according to claim 11 further comprising means releasably closing the second opening, said rod having a distal end for displacing the closing means.

14. A control valve according to claim 13 further comprising means within the second chamber for biasing the closing means toward a closed position.

15. A control valve according to claim 11 further comprising a discharge opening from the second chamber.

16. A control valve according to claim 7 wherein the hydraulic accumulator contains an elastically compressible means for responding to pressure changes in the pressure chamber to which the accumulator is connected.

17. A control valve according to claim 16 wherein the elastically compressible means is a gas.

* * * * *